US009128468B2

(12) United States Patent
Grossenbacher et al.

(10) Patent No.: US 9,128,468 B2
(45) Date of Patent: Sep. 8, 2015

(54) METHOD FOR INSERTING A DECORATION IN AN EXTERNAL TIMEPIECE ELEMENT DEPOSITED BY ELECTROFORMING AND AN EXTERNAL ELEMENT MADE IN ACCORDANCE WITH THIS METHOD

(75) Inventors: Pascal Grossenbacher, Neuchatel (CH); Thomas Froelicher, Le Landeron (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 14/233,645

(22) PCT Filed: Jul. 17, 2012

(86) PCT No.: PCT/EP2012/064025

§ 371 (c)(1),
(2), (4) Date: Jan. 17, 2014

(87) PCT Pub. No.: WO2013/011034

PCT Pub. Date: Jan. 24, 2013

(65) Prior Publication Data

US 2014/0177401 A1 Jun. 26, 2014

(30) Foreign Application Priority Data

Jul. 20, 2011 (EP) ..... 11005933

(51) Int. Cl.
*G04D 3/00* (2006.01)
*G04B 19/10* (2006.01)
(Continued)

(52) U.S. Cl.
CPC *G04D 3/00* (2013.01); *C25D 1/003* (2013.01); *G04B 19/10* (2013.01); *G04B 45/00* (2013.01);
(Continued)

(58) Field of Classification Search
CPC .. G04B 47/042; G04B 45/0076; G04B 45/00; G04B 19/10; C25D 1/003; G04D 3/00; G04D 3/0048; G04D 3/0051
USPC ..... 368/80, 228, 232, 230; 205/72
See application file for complete search history.

(56) References Cited

U.S. PATENT DOCUMENTS 2,604,418 A * 7/1952 Stern ..... 148/244
3,054,175 A * 9/1962 Spreter ..... 156/232
(Continued)

FOREIGN PATENT DOCUMENTS

| | | |
|---|---|---|
| CH | 367117 | 10/1962 |
| CH | 403 654 | 8/1965 |
| EP | 2 192 454 A1 | 6/2010 |

OTHER PUBLICATIONS

International Search Report issued Aug. 21, 2012, in PCT/EP2012/064025, filed Jul. 17, 2012.

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

To fabricate an external timepiece element in which there is inserted at least one decoration, the decoration is formed of anterior and posterior parts respectively intended to emerge from the external element and to serve as a mechanism of anchoring the decoration in the external element. A master mold is provided, the master mold including a hollow pattern cavity matching dimensions of the anterior part of the decoration. The decoration is placed in the pattern cavity. The master mold is filled by the galvanic deposition of a metal. The external element obtained is removed from the master mold.

13 Claims, 2 Drawing Sheets

(51) Int. Cl.
*G04B 45/00* (2006.01)
*G04B 47/04* (2006.01)
*C25D 1/00* (2006.01)

(52) U.S. Cl.
CPC ..... *G04B 45/0076* (2013.01); *G04B 47/042* (2013.01); *G04D 3/0048* (2013.01); *G04D 3/0051* (2013.01)

(56) References Cited

U.S. PATENT DOCUMENTS 3,228,861 A * 1/1966 Vogt et al. ..... 205/120
3,675,295 A * 7/1972 Feller ..... 29/896.32
3,724,202 A * 4/1973 Feller ..... 368/232
4,710,276 A * 12/1987 Kull ..... 29/10
6,212,745 B1 4/2001 Pierre et al.
2005/0126917 A1* 6/2005 Morimoto ..... 205/50
2008/0066310 A1* 3/2008 Pang ..... 29/896.4
2009/0249608 A1* 10/2009 Podszuweit et al. ..... 29/527.1
2010/0202255 A1* 8/2010 Klopfenstein et al. ..... 368/226
2011/0236580 A1 9/2011 Winkler et al.
2011/0259753 A1* 10/2011 Grossenbacher et al. .... 205/162
2013/0021882 A1* 1/2013 Grossenbacher et al. .... 368/285

* cited by examiner

METHOD FOR INSERTING A DECORATION IN AN EXTERNAL TIMEPIECE ELEMENT DEPOSITED BY ELECTROFORMING AND AN EXTERNAL ELEMENT MADE IN ACCORDANCE WITH THIS METHOD

BACKGROUND

The present invention relates to a method of fabricating an external timepiece element into which at least one decoration is inserted.

It has already been proposed to insert a decoration into an external timepiece element. EP Patent Application No. 2192454A1 describes a decoration deposited by electroforming on an external element by means of a mask which is filled with a metallic material. This decoration may also include an anchoring means ensuring that the decoration is properly held in the element concerned, this anchoring means being also deposited by electroforming. It will be seen below that, in the present invention, it is the external element which is created by electroforming and not the decoration as proposed in the aforecited Patent Application.

It has also been proposed to fix a precious or artificial stone to a substrate made of cire perdue which is metallised and then coated with a metallic layer deposited by electroforming, said layer holding the precious stone in place. This method is disclosed in U.S. patent application Ser. No. 2008/0066310A1.

An electroplating deposition is also used to hold a precious stone on a base in U.S. Pat. No. 6,212,745B1.

BRIEF SUMMARY

Contrary to the teaching of the aforecited documents, in addition to complying with the statement in the first paragraph of this specification, the present method is characterized in that it includes the following series of steps: taking a decoration made of anterior and posterior parts respectively intended to emerge from the external element and to serve as anchoring means for said decoration in said external element; taking a master mould mould made in the dimensions of the external element, said master mould mould having a hollow pattern cavity matching the dimensions of the anterior part of the decoration; placing the decoration in the master mould, the posterior part of the decoration filling the pattern cavity made in the master mould; filling the master mould by the galvanic deposition of a metal to obtain the required external element, and removing the external element obtained from the master mould.

The present invention also concerns the external timepiece element made in accordance with the above method.

BRIEF DESCRIPTION OF THE DRAWINGS

The features and advantages of the present invention will appear from the following description, given with reference to the annexed drawings, and providing, by way of explanatory, but non-limiting example, advantageous embodiments. In the drawings.

DETAILED DESCRIPTION

Figure 1:
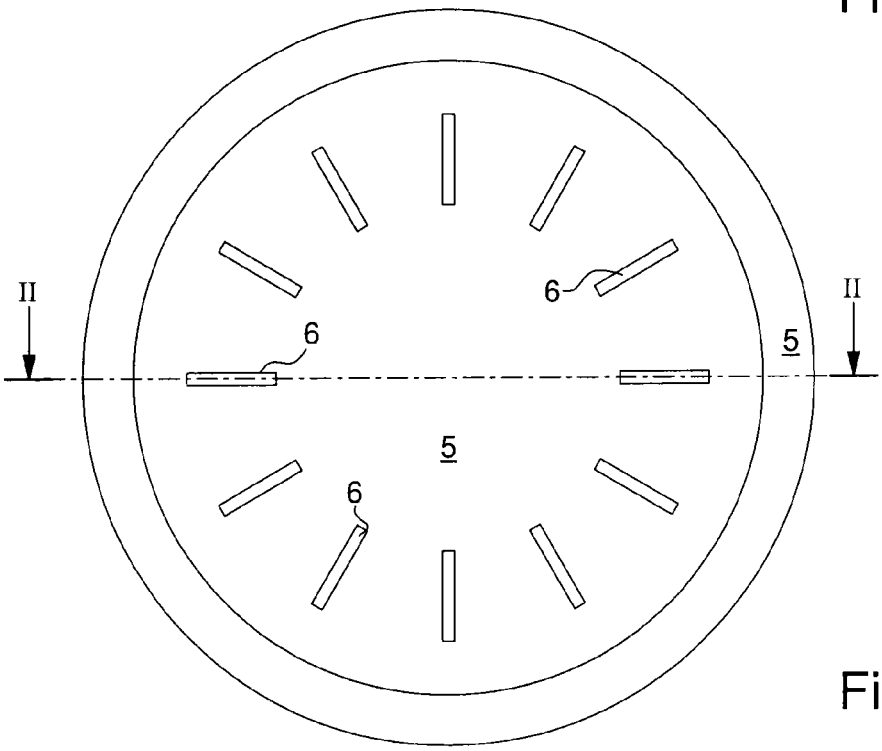
FIG. 1 is a top view of an example master mould used to produce an external timepiece element, in this case a watch dial.
Figure 2:
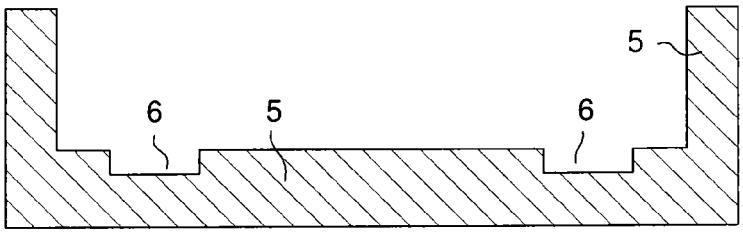
FIG. 2 is a cross-section along the line II-II of FIG. 1.
Figure 3:
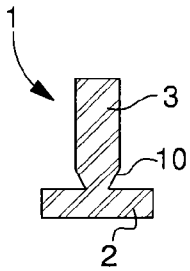
FIG. 3 shows a cross-section of a decoration to be inserted into the master mould of FIGS. 1 and 2, in this case a time indicator index.

FIG. 3 is a cross-section of a decoration 1 to be inserted into an external timepiece element 4 (FIG. 7), for example a time indicator index on a dial. This decoration 1 includes an anterior part 2 which will emerge from the external element and a posterior part 3 which will serve as anchorage in said element. FIGS. 1 and 2 are respectively a top view and a cross-section of a master mould 5 made in the dimensions of the external element to be produced. This master mould 5 has a hollow pattern cavity 6 matching the dimensions of the anterior part 2 of decoration 1. Since this concerns a watch dial here, master mould 5 will have twelve pattern cavities 6 for receive twelve time indicator indices.

Figure 4:
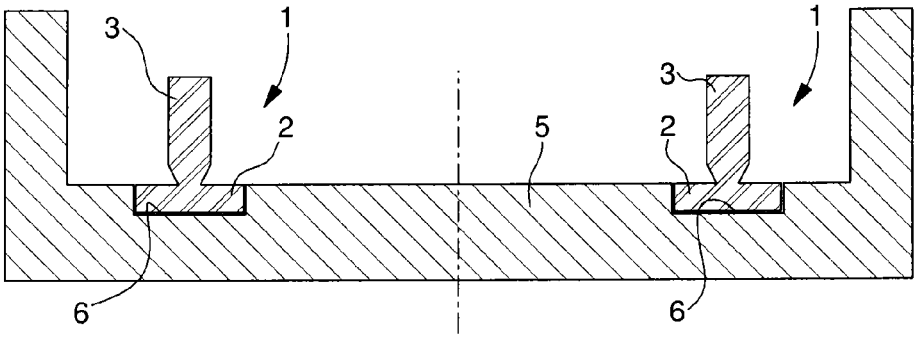
FIG. 4 shows the operation of depositing the decoration in the master mould of FIGS. 1 and 2.
Figure 5:
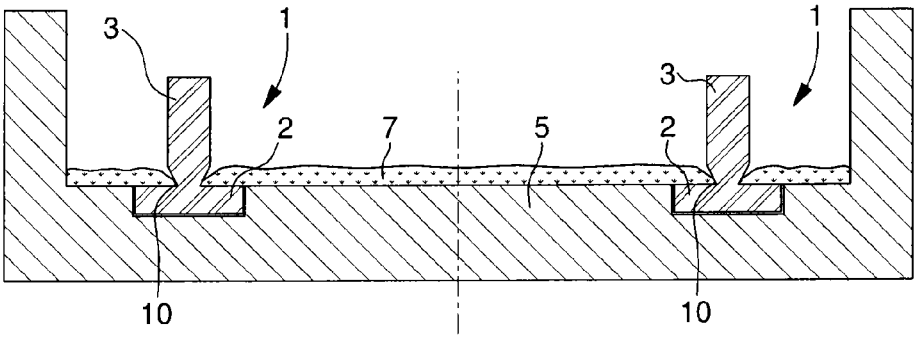
FIG. 5 shows the start of the operation of filling the master mould with metal deposited by electroforming.
Figure 6:
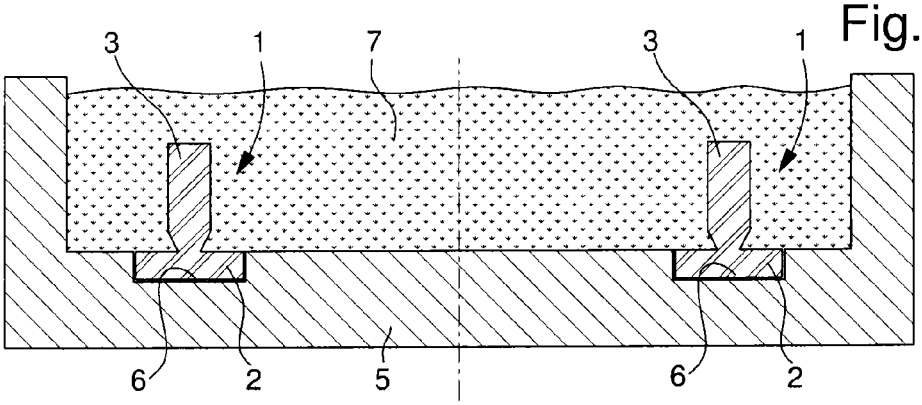
FIG. 6 shows the end of the operation of filling the master mould.

FIG. 4 shows the operation of placing decoration 1 in master mould 5, anterior part 2 of decoration 1 filling pattern cavity 6 made in master mould 5. When decoration 1 is in place, it is possible to begin filling master mould 5, as shown clearly in FIG. 5. The filling is achieved by the galvanic deposition of a metal 7, for example gold, copper, nickel, platinum, silver palladium or any metal or metal alloy which can be electrodeposited and is advantageous for the watchmaking industry. The filling stops when the deposition passes the end of posterior part 3 of decoration 1, as shown in FIG. 6.

Figure 7:
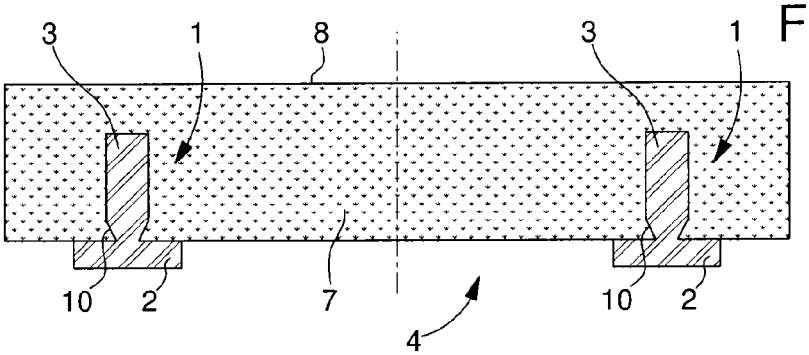
FIG. 7 shows the final external timepiece element obtained by removal from the master mould.

FIG. 7 shows the finished external timepiece element 4 when it has been extracted from master mould 5. After removal from the mould, the back face 8 can be levelled if necessary.

Two cases may occur here, depending upon whether master mould 5 is made of metal or non-electroconductive material.

If master mould 5 is made of metal, the surface thereof must be treated by a chemical passivation which coats the surface with a fine oxide layer before performing the galvanic deposition of the external element. This layer is dimensioned to attract the electrodeposited metal without permanently adhering to master mould 5, thereby allowing the master mould to be separated from the external element.

If master mould 5 is made of non-electroconductive material, for example a plastic or ceramic material, the surface thereof must then be coated with a metallisation to make the surface conductive and thus attract the electrodeposited metal. Thus, for example, a fine layer of chromium (50 nm) and gold (50 nm) may be deposited by PVD, to which the galvanic deposition will be able to adhere while also allowing the external element to be removed from the mould.

Two other cases may also arise, depending upon whether the decoration is made of metal or non electroconductive material.

If the decoration is made of metal, there will be total adherence of the external element to the posterior part 3 of decoration 1. If the decoration is made of non-conductive material, the electrolytic deposition will first of all overlap a draft 10 shown in FIG. 5, which will be discussed below, then the top of posterior part 3 of decoration 1, before finally completely surrounding said decoration 1 as shown in FIG. 6.

Figure 8:
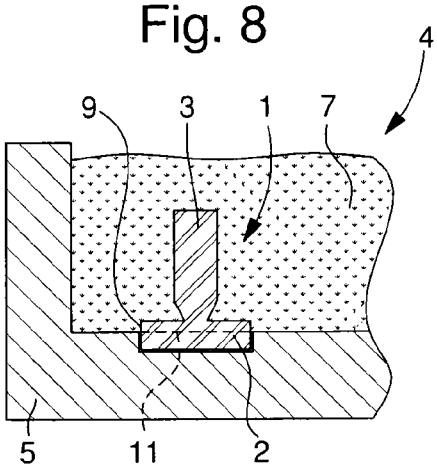
FIG. 8 shows a variant of the decoration after the master mould has been filled.

FIG. 8 shows that a back portion 9 of anterior part 2 of decoration 1 is held in metal 7 of external element 4. This method of making the decoration, which is different from that shown up to now where the decoration physically emerges from the finished external part, enables the decoration to be placed level with the external element after the latter has been removed from the mould, if anterior part 2 of decoration 1 is milled to line 11. Decoration 1 is then flush with the external element and is distinguished from the latter by a different colour, for example steel for the decoration and galvanic gold for external element 4.

The Figures illustrating decoration 1 show that the posterior part 3 of decoration 1 is provided with a draft 10. It is thus clear that the draft provides a constant secure mechanical hold of decoration 1 in external element 4.

The external timepiece element 4 discussed above may be a watch dial as stated above. It could also be a bezel carrying hour symbols, a middle part of a timepiece or a bracelet loop bearing a trademark or brand.

The invention claimed is:

1. A method of fabricating an external timepiece element in which at least one discrete decoration element is inserted, the method comprising:

a) taking a discrete decoration element including an anterior part and a posterior part respectively intended to emerge from the external element and to serve as a means of anchoring the discrete decoration element in the external timepiece element;

b) taking a master mold made in dimensions of the external element, the master mold including a hollow pattern cavity, and matching dimensions of the anterior part of the discrete decoration element;

c) placing the discrete decoration element in the master mold, the anterior part of the discrete decoration element filling the pattern cavity made in the master mold;

d) after c), filling the master mold by galvanic deposition of a metal to obtain a the external element; and e) removing the external element from the master mold.

2. The method according to claim 1, wherein c) is preceded by a chemical passivation of the master mold if the master mold is made of metal.

3. The method according to claim 1, wherein c) is preceded by a metallizing the master mold if the master mold is made of a non-electroconductive material.

4. The method according to claim 1, wherein the discrete decoration element is a metal.

5. The method according to claim 1, wherein the discrete decoration element is made of a non-electroconductive material.

6. The method according to claim 1, wherein a portion of a back of the anterior part of the discrete decoration element is held in the metal of the external element.

7. The method according to claim 1, wherein the posterior part of the discrete decoration element includes a retaining draft.

8. An external timepiece element made according to the method defined in claim 1, wherein the external element is a watch dial.

9. The external timepiece element according to claim 8, wherein the watch dial includes a plurality of discrete decoration elements indicating hours.

10. The external timepiece element according to claim 8, wherein the anterior part of the discrete decoration element fills the pattern cavity made in a bottom face of the master mold such that, after the external element is removed from the master mold, the anterior part of the discrete decoration element protrudes from a top face of the watch dial.

11. The method according to claim 1, wherein the placing of the discrete decoration element in the master mold is completed prior to the filling the master mold by galvanic deposition of a metal to obtain the external element.

12. The method according to claim 1, wherein the filling the master mold by galvanic deposition of a metal to obtain the external element includes surrounding the posterior part of the discrete decoration element with the metal of the external element by the galvanic deposition.

13. The method according to claim 1, wherein the anterior part of the discrete decoration element fills the pattern cavity made in a bottom face of the master mold such that, after the external element is removed from the master mold, the anterior part of the discrete decoration element protrudes from a top face of the external element.

* * * * *